US008137884B2

(12) United States Patent
Sacripante et al.

(10) Patent No.: US 8,137,884 B2
(45) Date of Patent: Mar. 20, 2012

(54) TONER COMPOSITIONS AND PROCESSES

(75) Inventors: Geurino G. Sacripante, Oakville (CA); Chieh-Min Cheng, Rochester, NY (US); Gwynne E. McAneney Lannen, Burlington (CA)

(73) Assignee: Xerox Corporation, Norwalk, CT (US)

( * ) Notice: Subject to any disclaimer, the term of this patent is extended or adjusted under 35 U.S.C. 154(b) by 803 days.

(21) Appl. No.: 11/956,878

(22) Filed: Dec. 14, 2007

(65) Prior Publication Data

US 2009/0155703 A1 Jun. 18, 2009

(51) Int. Cl.
*G03G 9/00* (2006.01)

(52) U.S. Cl. ..... 430/109.4; 430/108.1; 430/137.14

(58) Field of Classification Search ..... 430/109.4, 430/108.1, 137.14
See application file for complete search history.

(56) References Cited

U.S. PATENT DOCUMENTS

| | | | |
|---|---|---|---|
| 3,847,604 | A | 11/1974 | Hagenbach et al. |
| 4,935,326 | A | 6/1990 | Creatura et al. |
| 4,937,166 | A | 6/1990 | Creatura et al. |
| 5,004,664 | A | 4/1991 | Fuller et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,922,501 | A | 7/1999 | Cheng et al. |
| 5,925,488 | A | 7/1999 | Patel et al. |
| 5,945,245 | A | 8/1999 | Mychajlowskij et al. |
| 5,977,210 | A | 11/1999 | Patel et al. |
| 5,994,020 | A | 11/1999 | Patel et al. |
| 6,120,967 | A | 9/2000 | Topper et al. |
| 6,416,920 | B1 | 7/2002 | Topper et al. |
| 6,495,302 | B1 | 12/2002 | Jiang et al. |
| 6,500,597 | B1 | 12/2002 | Patel et al. |
| 6,541,175 | B1 | 4/2003 | Jiang et al. |
| 6,576,389 | B2 | 6/2003 | Vanbesien et al. |
| 6,617,092 | B1 | 9/2003 | Patel et al. |
| 6,627,373 | B1 | 9/2003 | Patel |
| 6,635,782 | B2 | 10/2003 | Honma et al. |
| 6,638,677 | B2 | 10/2003 | Patel et al. |
| 6,645,743 | B1 | 11/2003 | Honma et al. |
| 6,649,381 | B1 | 11/2003 | Honma et al. |
| 6,650,255 | B2 | 11/2003 | Bruekers et al. |
| 6,656,657 | B2 | 12/2003 | Patel et al. |
| 6,656,658 | B2 | 12/2003 | Patel et al. |
| 6,664,017 | B1 | 12/2003 | Patel et al. |
| 6,673,505 | B2 | 1/2004 | Jiang et al. |
| 6,777,153 | B2 | 8/2004 | Yano et al. |
| 6,855,472 | B2 | 2/2005 | Imamura et al. |
| 6,858,367 | B2 | 2/2005 | Yano et al. |
| 6,908,720 | B2 | 6/2005 | Kenmoku et al. |
| 6,908,721 | B2 | 6/2005 | Kenmoku et al. |
| 7,001,702 | B2 | 2/2006 | Cheng et al. |
| 7,045,321 | B2 | 5/2006 | Imamura et al. |
| 2007/0148576 | A1 * | 6/2007 | Ishiyama et al. ..... 430/106.1 |

FOREIGN PATENT DOCUMENTS

| | | |
|---|---|---|
| EP | 0 640 882 A1 | 3/1995 |
| EP | 1 253 476 A2 | 10/2002 |
| JP | A-5-74492 | 3/1993 |
| JP | A-5-93049 | 4/1993 |
| JP | A-6-15604 | 1/1994 |
| JP | A-7-14352 | 1/1995 |
| JP | A-7-265065 | 10/1995 |
| JP | A-8-19227 | 1/1996 |
| JP | A-9-191893 | 7/1997 |

OTHER PUBLICATIONS

C. Wu, "Weight Control for Bacterial Plastic", *Science News*, pp. 23-25, vol. 151:2, Jan. 11, 1997.

R. Lenz et al., "Bacterial Polyesters: Biosynthesis, Biodegradable Plastics and Biotechnology", *Bio Macromolecules*, vol. 6, No. 1, Jan./Feb. 2005.

U.S. Appl. No. 11/187,007, filed Jul. 22, 2005.

U.S. Appl. No. 11/003,581, filed Dec. 3, 2004.

U.S. Appl. No. 11/044,847, filed Jan. 27, 2005.

U.S. Appl. No. 10/948,450, filed Sep. 23, 2004.

U.S. Appl. No. 10/606,298, filed Jun. 25, 2003.

* cited by examiner

*Primary Examiner* — Mark A Chapman
(74) *Attorney, Agent, or Firm* — Oliff & Berridge, PLC

(57) ABSTRACT

A toner composition includes toner particles including a polymeric resin, a colorant, a wax, and a optional coagulant.

12 Claims, No Drawings

TONER COMPOSITIONS AND PROCESSES

RELATED APPLICATIONS

Illustrated in copending application U.S. Ser. No. 11/187,007, filed Jul. 22, 2005, entitled Emulsion Aggregation Toner, Developer, and Method of Making the Same, is a toner comprising particles of a resin, a colorant, an optional wax, and a polyion coagulant, wherein the toner is prepared by an emulsion aggregation process. In embodiments, the resin is polyester resin, such as a sulfonated polyester resin. The toner can be made by a process comprising: mixing a resin emulsion, a colorant dispersion, and an optional wax to form a mixture; adding an organic or an inorganic acid to the mixture; adding a polyion coagulant to the mixture; heating the mixture, permitting aggregation and coalescence of the resin and colorant, and optionally cooling the mixture and isolating the product, wherein the polyion coagulant is added to the mixture at least one of before or during the heating.

Illustrated in copending application U.S. Ser. No. 11/003,581, filed Dec. 3, 2004, entitled Toner Compositions, is a toner composition comprising: a resin substantially free of cross linking; a cross linked resin; a wax; and a colorant. For example, the application illustrates a toner process comprising: mixing a resin substantially free of cross linking and a cross linked resin in the presence of a wax, a colorant, and a coagulant to provide toner size aggregates; adding additional resin substantially free of cross linking to the formed aggregates thereby providing a shell over the formed aggregates; heating the shell covered aggregates to form toner; and optionally, isolating the toner.

Illustrated in copending application U.S. Ser. No. 11/044,847, filed Jan. 27, 2005, entitled Hybrid Toner Processes, is a toner process comprised of a first heating of a colorant dispersion, a first latex emulsion, a second latex emulsion, and a wax dispersion in the presence of a coagulant containing a metal ion; adding a third latex; adding an organic sequestering compound or a silicate salt sequestering compound, followed by a second heating wherein the first heating is accomplished at below about the first latex polymer glass transition temperature, and the second heating is above about the first latex polymer glass transition temperature, and wherein the first latex and the third latex are free of a polyester, and the second latex contains a polyester.

Illustrated in copending application U.S. Ser. No. 10/948,450, filed Sep. 23, 2004, entitled Low Melt Toners and Processes Thereof, is a process for preparing a low-melt toner, the process comprising: forming a pre-toner mixture comprising a first alkali sulfonated polyester resin, a second alkali sulfonated polyester resin and a colorant; adding an aggregating agent to the pre-toner mixture and aggregating the mixture to form an aggregate mix comprising a plurality of aggregate toner particles; coalescing the aggregate mix at a temperature of from about 5 to about 20° C. above the glass transition temperature ($T_g$) of one of the first or second alkali sulfonated polyester resins to form a mixture of coalesced toner particles; and cooling the mixture of coalesced toner particles.

Illustrated in copending application U.S. Ser. No. 10/606,298, filed Jun. 25, 2003, entitled Toner Processes, is a toner process comprised of a first heating of a mixture of an aqueous colorant dispersion, an aqueous latex emulsion, and an aqueous wax dispersion in the presence of a coagulant to provide aggregates, adding a base followed by adding an organic sequestering agent, and thereafter accomplishing a second heating, and wherein the first heating is below about the latex polymer glass transition temperature (Tg), and the second heating is about above the latex polymer glass transition temperature.

The appropriate components, such as for example, waxes, coagulants, resin latexes, surfactants, and colorants, and processes of the above copending applications and patents may be selected for the present disclosure in embodiments thereof. The entire disclosures of the above-mentioned applications are totally incorporated herein by reference.

TECHNICAL FIELD

This disclosure is generally directed to toner compositions and toner processes, such as emulsion aggregation process as well as toner compositions formed by such process. More specifically, this disclosure is generally directed to emulsion aggregration processes utilizing a bio-based polyester resin.

BACKGROUND

Emulsion aggregation toners are used in forming print and/or xerographic images. Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are heated to enable coalescence/fusing, thereby achieving aggregated, fused toner particles. United States patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215.

Illustrated herein in embodiments are toner processes, and more specifically, emulsion aggregation and coalescence processes. More specifically, disclosed in embodiments are methods for the preparation of toner compositions by a chemical process, such as emulsion aggregation, wherein biodegradable semicrystalline polyester resin and mixtures thereof, are aggregated with a wax and a colorant, in the presence of a coagulant such as a polymetal halide or other monovalent or divalent metal coagulants, and thereafter stabilizing the aggregates and coalescing or fusing the aggregates such as by heating the mixture above the resin Tg to provide toner size particles.

Two main types of emulsion aggregation toners are known in the art. The first main type of emulsion aggregaton toner uses/forms acrylate based, such as styrene acrylate, toner particles. See, for example, U.S. Pat. No. 6,120,967.

The second main type of emulsion aggregation toner/process uses/forms polyester, such as sulfonated polyester toner particles. See, for example, U.S. Pat. No. 5,916,725. Examples of sulfonated polyester toner particles include poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene-sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), and copoly(propoxylated bisphenol A)-copoly-(propoxylated bisphenol A-sodio 5-sulfoisophthalate).

Conventionally, polyesters in toners are derived from bisphenol A, which is a known carcinogen/endocrine disrupter. It is highly likely that greater public restrictions on use of this chemical will be put into place in the future. Thus, alternative non-bisphenol A polyesters are needed. The disclosed biodegradable resins may very well be suitable replacements.

Several forms of these biodegradable resins are available commercially, and are made first as submicron aqueous emulsions. For most applications, the emulsions are subsequently dried before end use. However, for emulsion aggregation applications, the emulsions are particularly useful because the costly polyester resin emulsification step is elimination.

REFERENCES

In U.S. Pat. No. 5,004,664, there is illustrated a biodegradable toner resin compositions comprised of the semicrystalline polyesters obtained by the synthetic processes.

Illustrated in U.S. Pat. No. 5,994,020, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally cooling, isolating, washing, and drying the toner.

Illustrated in U.S. Pat. No. 6,541,175, is a process comprising:

(i) providing or generating an emulsion latex comprised of sodio sulfonated polyester resin particles by heating the particles in water at a temperature of from about 65° C. to about 90° C.;

(ii) adding with shearing to the latex (i) a colorant dispersion comprising from about 20 percent to about 50 percent of a predispersed colorant in water, followed by the addition of an organic or an inorganic acid;

(iii) heating the resulting mixture at a temperature of from about 45° C. to about 65° C. followed by the addition of a water insoluble metal salt or a water insoluble metal oxide thereby releasing metal ions and permitting aggregation and coalescence, optionally resulting in toner particles of from about 2 to about 25 microns in volume average diameter; and optionally (iv) cooling the mixture and isolating the product.

Also of interest is U.S. Pat. No. 6,416,920, which illustrates a process for the preparation of toner comprising mixing a colorant, a latex, and a silica, which silica is coated with an alumina.

Illustrated in U.S. Pat. No. 6,495,302, is a process for the preparation of toner comprising (i) generating a latex emulsion of resin, water, and an ionic surfactant, and a colorant dispersion of a pigment, water, an ionic surfactant, or a nonionic surfactant, and wherein (ii) the latex emulsion is blended with the colorant dispersion;

(iii) adding to the resulting blend containing the latex and colorant a coagulant of a polyaluminum chloride with an opposite charge to that of the ionic surfactant latex colorant;

(iv) heating the resulting mixture below or equal to about the glass transition temperature (Tg) of the latex resin to form aggregates;

(v) optionally adding a second latex comprised of submicron resin particles suspended in an aqueous phase (iv) resulting in a shell or coating wherein the shell is optionally of from about 0.1 to about 1 micron in thickness, and wherein optionally the shell coating is contained on 100 percent of the aggregates;

(vi) adding an organic water soluble or water insoluble chelating component to the aggregates of (v) particles, followed by adding a base to change the resulting toner aggregate mixture from a pH which is initially from about 1.9 to about 3 to a pH of about 5 to about 9;

(vii) heating the resulting aggregate suspension of (vi) above about the Tg of the latex resin;

(viii) optionally retaining the mixture (vii) at a temperature of from about 70° C. to about 95° C.;

(ix) changing the pH of the (viii) mixture by the addition of an acid to arrive at a pH of about 1.7 to about 4; and (x) optionally isolating the toner.

Illustrated in U.S. Pat. No. 6,500,597, is a process comprising (i) blending a colorant dispersion of a pigment, water, and an anionic surfactant, or a nonionic surfactant with (ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product.

Emulsionlaggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210.

In addition, the following U.S. Patents relate to emulsion aggregation toner processes.

U.S. Pat. No. 5,922,501, illustrates a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245, illustrates a surfactant free process for the preparation of toner comprising heating a mixture of an emulsion latex, a colorant, and an organic complexing agent.

The disclosures of each of the foregoing patents and publications are hereby incorporated by reference herein in their entireties. The appropriate components and process aspects of the each of the foregoing patents and publications may also be selected for the present compositions and processes in embodiments thereof.

There is a need in the art for improved emulsion aggregation toners and processes. There is also a need in the art for environmentally friendly emulsion aggregation toners and processes.

SUMMARY

Emulsion aggregation toner compositions and emulsion aggregation processes for preparing toner compositions are described. The emulsion aggregation toner compositions comprise one or more semicrystalline biodegradable, thermoplastic polyester resins, wherein the toner composition is prepared by an emulsion aggregation process. In embodiments, the emulsion aggregation toner composition comprises one or more polyhydroxyalkanoate (PHA) resins having the formula:

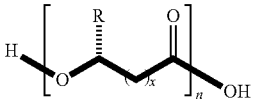

wherein R is H or a substituted or unsubstituted alkyl group from 1 to about 13 carbon atoms, and X is 1 to about 3.

Examples of polyhydroxyalkanoates include polyhydroxybutyrate (PHB), polyhydroxyvalerate (PHV), and copolyesters containing randomly arranged units of 3-hydroxybutyrate (HB) and 3-hydroxyvalerate (HV), such as poly-beta-hydroxybutyrate-co-beta-hydroxyvalerate. The resins can also include blends of the polyhydroxyalkanoates. The biodegradable semi-crystalline polymeric resin may also be in the form of a mixture with another resin.

The toner compositions of the present disclosure may further comprise a colorant, a wax, and a coagulant such as a monovalent metal, divalent metal, or polyion coagulant, wherein said toner is prepared by an emulsion aggregation process, and where the coagulant is incorporated into the toner particles.

Emulsion aggregation processes are also described. In embodiments, an emulsion aggregation processes of the disclosure comprises forming an emulsion latex of the resin particles, which resin particles are one or more PHA resins described herein, such as polyhydroxybutyrate (PHB), polyhydroxyvalerate (PHV), or a copolyester containing randomly arranged units of 3-hydroxybutyrate (HB) and 3-hydroxyvalerate (HV), such as poly-beta-hydroxybutyrate-co-beta-hydroxyvalerate and blends thereof. The emulsion aggregation process further comprises heating the toner particles in combination with one or more additional ingredients used in emulsion aggregation toners (such as one or more colorants/pigments, coagulants, additional resins, and/or waxes) to enable coalescence/fusing) to obtain aggregated, fused toner particles.

In an embodiment, the present disclosure provides a toner composition comprised of:

- toner particles comprising:
  - a semicrystalline biodegradable polyester resin;
  - a colorant;
  - a wax; and
  - a coagulant;
- wherein said toner composition is an emulsion aggregation toner composition.

In another embodiment, the present disclosure provides a process for preparing a toner, comprising:

- mixing a semicrystalline biodegradable polyester resin emulsion; a colorant dispersion, and a wax to form a mixture;
- adding a coagulant to said mixture;
- adding an organic or an inorganic acid to said mixture;
- heating the mixture, permitting aggregation and coalescence of said semicrystalline biodegradable polyester resin, colorant, and wax, to form toner particles; and
- optionally cooling the mixture and isolating the toner particles.

EMBODIMENTS

The toner of the present disclosure is comprised of toner particles comprised of at least a semicrystalline biodegradable polymeric resin. The toner compositions may further comprise a wax, a pigment or colorant, and an optional coagulant. The toner particles may also include other conventional optional additives, such as colloidal silica (as a flow agent).

The semi-crystalline biodegradable polymeric resin selected for the toner of the present disclosure can include polyhydroxyalkanoates having the formula:

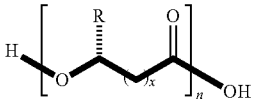

wherein each R is independently H or a substituted or unsubstituted alkyl group of from 1 to about 13 carbon atoms, X is 1 to about 3, and n is a degree of polymerization of from about 50 to about 20,000. In the formula, R can be substituted with groups such as, for example, silyl groups; nitro groups; cyano groups; halide atoms, such as fluoride, chloride, bromide, iodide, and astatide; amine groups, including primary, secondary, and tertiary amines; hydroxy groups; alkoxy groups, such as having from 1 to about 20 carbon atoms such as from 1 to about 10 carbon atoms; aryloxy groups, such as having from about 6 to about 20 carbon atoms such as from about 6 to about 10 carbon atoms; alkylthio groups, such as having from 1 to about 20 carbon atoms such as from 1 to about 10 carbon atoms; arylthio groups, such as having from about 6 to about 20 carbon atoms such as from about 6 to about 10 carbon atoms; aldehyde groups; ketone groups; ester groups; amide groups; carboxylic acid groups; sulfonic acid groups; and the like.

Polyhydroxyalkanoate resins are known in the art and include polyhydroxybutyrate (PHB), polyhydroxyvalerate (PHV) and copolyesters containing randomly arranged units of 3-hydroxybutyrate (HB) and 3-hydroxyvalerate (HV), such as, poly-beta-hydroxybutyrate-co-beta-hydroxyvalerate, and blends thereof. Polyhydroxyalkanoate resins are described, for example in U.S. Pat. No. 5,004,664 and Lenz et al., which are hereby incorporated by reference.

Polyhydroxyalkanoate resins may be obtained from any suitable source, such as, by a synthetic process, as described in U.S. Pat. No. 5,004,664, or by isolating the resin from a microorganism capable of producing the resin. Examples of microganisms that are able to produce polyhydroxyalkanoate resins include, for example, *Alcaligenes eutrophus, Methylobacterium* sp., *Paracoccus* sp., *Alcaligenes* sp., *Pseudomonas* sp., *Comamonas acidovorans* and *Aeromonas caviae* as described, for example in Lentz et al., Japanese Patent Application Laid-Open No. 5-74492, Japanese Patent Publication Nos. 6-15604, 7-14352, and 8-19227, Japanese Patent Application Laid-Open No. 9-191893), and Japanese Patent Application Laid-Open Nos. 5-93049 and 7-265065), the entire disclosures of which are incorporated herein by reference. Also see Polyhydroxyalkaoate resins described in U.S. Pat. Nos. 6,645,743; 6,635,782; 6,649,381; 6,777,153; 6,855,472; 6,858,367; 6,908,720; 6,908,721; 7,045,321; the entire disclosures of which are incorporated herein by reference.

In a particular embodiment, the polyhydroxyalkanoates is obtained from *Alcaligenes europhus*. This bacterium has been demonstrated to produce resins in beads with varying particle size of up to 1 micron. Moreover, as disclosed in Wu, Corrinna, 1997, Sci. News. "Weight Control for bacterial plastics,' p. 23-25, vol. 151:2, the size of the resin can be controlled from less than about 250 nm in diameter.

In embodiments, the polyhydroxyalkanoates resins described herein have a particle size of less than about 250 nm, such as in a range of from about 50 to about 250 nanometers (nm) in diameter (including 50 to 250 nm). Polyhydroxyalkanoates resins having a particle size ranging of less than about 250 nm, such as in a range of from about 50 to about 250 nm are particularly suitable for emulsion aggregation processes as such PHA resins can be used directly in an emulsion aggregation process to prepare toners without the need to use organic solvents to obtain the desired size range of resins. The avoidance of organic solvents in turn results in a more environmentally friendly process.

Accordingly, in embodiments, an emulsion aggregation process involves the formation of an emulsion latex of the resin particles, which resin particles are one or more of the polyhydroxyalkanoates resins described herein having a particle size of from about 50 to 250 nm in diameter. The toner particles, in combination with additional ingredients used in emulsion aggregation toners (for example, one or more colorants, coagulants, additional resins, and/or waxes) are heated to enable coalescence/fusing, thereby achieving aggregated, fused toner particles. In an embodiment, the emulsion aggregation process is carried out without the use of an organic solvent to obtain the desired particle size of the resin.

The polyhydroxyalkanoates resins described herein may be obtained from any suitable source or process, such as, synthetic processes and/or biosynthetic processes from a microbial source. In an embodiment, the polyhydroxyalkanoates resin is prepared biosynthetically by fermenting a microorganism (for example bacterium) capable of producing the polyhydroxyalkanoates resin and isolating the polyhydroxyalkanoates resin from the microorganism for use in an emulsion aggregation toner/process. In another embodiment, the polyhydroxyalkanoates resin is obtained from a microorganism and the polyhydroxyalkanoates resin has a particle size of about less than about 250 nm, such as in a range of about 50 to about 250 nm. Suitable microbial sources include, for example, the bacterium *Alcaligense europhus*. In another embodiment, an emulsion aggregation toner composition is disclosed having a polyhydroxyalkanoates resin as described herein having a particle size in a range of about 50 to about 250 nm and wherein the polyhydroxyalkanoates resin is obtained from the bacterium *Alcaligense europhus*.

In another embodiment, an emulsion aggregation process comprises the formation of an emulsion latex of the resin particles, which resin particles are polyhydroxyalkanoates resins described herein having a particle size of from about 50 to 250 in diameter and wherein the resin particles are obtained from a bacterium, particularly from the bacterium *Alcaligense europhus*. These toner particles, in combination with additional ingredients used in emulsion aggregation toners (such as one or more colorants, coagulants, additional resins, and/or waxes) are heated to enable coalescence/fusing, thereby achieving aggregated, fused toner particles.

In another embodiment, an emulsion aggregation process involves the formation of an emulsion latex of the resin particles, which resin particles comprise one or more of the polyhydroxyalkanoates resins described herein. In an embodiment, the process for preparing the polyhydroxyalkanoates resin toner composition comprises mixing one or more of the polyhydroxyalkanoates resins described herein with a wax, a colorant, and a coagulant to provide toner size aggregates; optionally adding additional resin to the formed aggregates thereby providing a shell having a thickness of for example about 0.1 to about 2 or about 5 microns, such as about 0.3 to about 0.8 micrometers, over the formed aggregates; heating the optionally shell covered aggregates to form toner; and, optionally, isolating the toner. In embodiments, the heating comprises a first heating below the glass transition temperature of the resin substantially free of cross linking and a second heating above the glass transition temperature of the resin substantially free of cross linking.

In another embodiment, the present disclosure provides a process for preparing a toner, comprising mixing one or more of the polyhydroxyalkanoates resins described herein, a colorant dispersion, and a wax to form a mixture; adding a coagulant to said mixture; adding an organic or an inorganic acid to said mixture; heating the mixture, permitting aggregation and coalescence of said polymeric resin, and mixtures thereof, colorant, and wax, to form toner particles, and optionally cooling the mixture and isolating the toner particles.

Commercial polyhydroxyalkanoates resins known in the art include BIOPOL (available from Imperial Chemcial Industries, Ltd (ICI), England), or Mirel™ product line in solid or emulsion form (available from Metabolix).

The polyhydroxyalkanoates resin may be present in the toner in various effective amounts such as, for example, from about 5 weight percent to about 95 weight percent, such as about 70 weight percent to about 95 weight percent, or about 80 weight percent to about 90 weight percent. Other amounts outside the ranges indicated may be selected. Amounts of the polyhydroxyalkanoates resins may vary if other resins (for example non PHA resins) are used.

The polyhydroxyalkanoates resin may be in the form of a mixture with another resin. Other resins include, such as polyester and/or its derivatives, including polyester resins and branched polyester resins, polyimide resins, branched polyimide resins, poly(styrene-acrylate) resins, crosslinked poly (styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and the like. In an embodiment, for example, a particularly desirable resin is a biodegradable semicrystalline polyester resin made by fermentation.

Illustrative examples of polymer resins include any of the various polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(propoxylated bisphenol-fumarate), poly(propoxylated bisphenol-succinate), poly (propoxylated bisphenol-adipate), poly(propoxylated bisphenol-glutarate), SPAR™ (Dixie Chemicals), BECKOSOL™ (Reichhold Chemical Inc), ARAKOTE™ (Ciba-Geigy Corporation), HETRON™ (Ashland Chemical), PARAPLEX™ (Rohn & Hass), POLYLITE™ (Reichhold Chemical Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation) mixtures thereof and the like. The resins can also be functionalized, such as carboxylated, sulfonated, or the like, and particularly such as sodio sulfonated.

The latex polymer of embodiments can be either crystalline, amorphous, or a mixture thereof. Thus, for example, the toner particles can be comprised of crystalline latex polymer, amorphous latex polymer, or a mixture of two or more latex polymers where one or more latex polymer is crystalline and one or more latex polymer is amorphous.

The crystalline resins, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-ρ-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isopthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium or potassium, and the like. In embodiments, the alkali metal is lithium.

The polyester resin latex or emulsion can be prepared by any suitable means. For example, the latex or emulsion can be prepared by taking the resin and heating it to its melting temperature and dispersing the resin in an aqueous phase containing a surfactant. The dispersion can be carried out by various dispersing equipment such as ultimizer, high speed homogenizer, or the like to provide submicron resin particles. Other ways to prepare the polyester resin latex or emulsion include solubilizing the resin in a solvent and adding it to heated water to flash evaporate the solvent. External dispersion can also be employed to assist the formation of emulsion as the solvent is being evaporated. Polyester resin emulsions prepared by other means or methods can also be utilized in the preparation of the toner composition.

In addition to the latex polymer binder, the toners of the present disclosure may also contain a wax, typically provided in a wax dispersion, which wax dispersion can be of a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When a wax dispersion is used, the wax dispersion can include any of the various waxes conventionally used in emulsion aggregation toner compositions. Suitable examples of waxes include polyethylene, polypropylene, polyethylene/amide, polyethylenetetrafluoroethylene, and polyethylene-tetrafluoroethylene/amide. Other examples include, for example, polyolefin waxes, such as polyethylene waxes, including linear polyethylene waxes and branched polyethylene waxes, and polypropylene waxes, including linear polypropylene waxes and branched polypropylene waxes; paraffin waxes; Fischer-Tropsch waxes; amine waxes; silicone waxes; mercapto waxes; polyester waxes; urethane waxes; modified polyolefin waxes (such as a carboxylic acid-terminated polyethylene wax or a carboxylic acid-terminated polypropylene wax); amide waxes, such as aliphatic polar amide functionalized waxes; aliphatic waxes consisting of esters of hydroxylated unsaturated fatty acids; high acid waxes, such as high acid montan waxes; microcrystalline waxes, such as waxes derived from distillation of crude oil; and the like. By "high acid waxes" it is meant a wax material that has a high acid content. The waxes can be crystalline or non-crystalline, as desired, although crystalline waxes are preferred, in embodiments. By "crystalline polymeric waxes" it is meant that a wax material contains an ordered array of polymer chains within a polymer matrix that can be characterized by a crystalline melting point transition temperature, Tm. The crystalline melting temperature is the melting temperature of the crystalline domains of a polymer sample. This is in contrast to the glass transition temperature, Tg, which characterizes the temperature at which polymer chains begin to flow for the amorphous regions within a polymer.

To incorporate the wax into the toner, it is desirable for the wax to be in the form of one or more aqueous emulsions or dispersions of solid wax in water, where the solid wax particle size is usually in the range of from about 100 to about 300 nm.

The toners also contain at least one pigment or colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 1% to about 25% by weight based upon the total weight of the composition. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), krgyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novapenn Yellow FGL (Hoechst), Permanent Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CT Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1% to about 35% by weight of the toner particles on a solids basis, such as from about 5% to about 25% by weight or fiom about 5 to about 15% by weight. However, amounts outside these ranges can also be used, in embodiments.

The toners of the present disclosure may also contain a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from 0 to about 5% by weight of the toner particles, such as from about greater than 0 to about 3% by weight of the toner particles.

Also, in preparing the toner by the emulsion aggregation procedure, one or more surfactants may be used in the process. Suitable surfactants include anionic, cationic and nonionic surfactants. In embodiments, the use of anionic and nonionic surfactants are preferred to help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN RK available from Daiichi Kogyo Seiyaku Co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecyl benzyl triethyl ammonium chloride, MIRAPOL and ALKAQUAT available from Alkaril Chemical Company, SANISOL (henzalkonium chloride), available from Kao Chemicals, and the like. An example of a suitable cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of the acids that can be utilized include, for example, nitric acid, sulfuric acid, hydrochloric acid, acetic acid, citric acid, trifluro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Any suitable emulsion aggregation procedure may be used in forming the emulsion aggregation toner particles without restriction. These procedures typically include the basic process steps of at least aggregating an emulsion containing polymer binder, one or more colorants, one or more waxes, one or more surfactants, an optional coagulant, and one or more additional optional additives to form aggregates, subsequently coalescing or fusing the aggregates, and then recovering, optionally washing and optionally drying the obtained emulsion aggregation toner particles.

For example, emulsion/aggregation/coalescing processes for the preparation of toners are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. patents may be selected for the present composition and process in embodiments thereof.

In embodiments hereof, the toner process comprises forming a toner particle by mixing the polymer latex, in the presence of a wax and a colorant dispersion to which is added an optional coagulant while blending at high speeds such as with a polytron. The resulting mixture having a pH of, for example, about 2.0 to about 3.0 is aggregated by heating to a temperature below the polymer resin Tg to provide toner size aggregates. Optionally, additional latex can be added to the formed aggregates providing a shell over the formed aggregates. The pH of the mixture is then changed, for example by the addition of a sodium hydroxide solution until a pH of about 7.0 is achieved. The temperature of the mixture is then raised to above the resin Tg, such as to about 95° C. After about 30 minutes, the pH of the mixture is reduced to a value sufficient to coalesce or fuse the aggregates to provide a composite particle upon further heating such as about 4.5. The fused particles can be measured for shape factor or circularity, such as with a Sysmex FPIA 2100 analyzer, until the desired shape is achieved.

The mixture is allowed to cool to room temperature (about 20° C. to about 25° C.) and is optionally washed to remove the surfactant. The toner is then optionally dried.

It is also desirable to control the toner particle size and limit the amount of both fine and coarse toner particles in the toner. In an embodiment, the toner particles have a very narrow particle size distribution with a lower number ratio geometric standard deviation (GSD) of approximately 1.15 to approximately 1.30, or approximately less than 1.25. The toner particles of the present disclosure also can have a size such that the upper geometric standard deviation (GSD) by volume is in the range of from about 1.15 to about 1.30, such as from about 1.18 to about 1.22, or less than 1.25. These GSD values for the toner particles of the present disclosure indicate that the toner particles are made to have a very narrow particle size distribution.

Shape factor is also a control process parameter associated with the toner being able to achieve optimal machine performance. The toner particles can have a shape factor of about 105 to about 170, such as about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular bases. This is a faster method to quantify the particle shape. The instrument used is an FPIA-2100 manufactured by Sysmex. For a completely circular sphere the circularity would be 1.000. The toner particles can have circularity of about 0.920 to 0.990 and, such as from about 0.940 to about 0.975.

In addition to the foregoing, the toner particles of the present disclosure also have the following Theological and flow properties. First, the toner particles can have the following molecular weight values, each as determined by gel permeation chromatography (GPC) as known in the art. The binder of the toner particles can have a weight average molecular weight, Mw of from about 15,000 daltons to about 90,000 daltons.

Overall, the toner particles in embodiments have a weight average molecular weight (Mw) in the range of about 17,000 to about 60,000 daltons, a number average molecular weight (Mn) of about 9,000 to about 18,000 daltons, and a MWD of about 2.1 to about 10. MWD is a ratio of the Mw to Mn of the toner particles, and is a measure of the polydispersity, or width, of the polymer. For cyan and yellow toners, the toner particles in embodiments can exhibit a weight average molecular weight (Mw) of about 22,000 to about 38,000 daltons, a number average molecular weight (Mn) of about 9,000 to about 13,000 daltons, and a MWD of about 2.2 to about 10. For black and magenta, the toner particles in embodiments can exhibit a weight average molecular weight (Mw) of about 22,000 to about 38,000 daltons, a number average molecular weight (Mn) of about 9,000 to about 13,000 daltons, and a MWD of about 2.2 to about 10.

Further, the toners if desired can have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values for the binder. Molecular peak is the value that represents the highest peak of the weight average molecular weight. In the present disclosure, the binder can have a molecular peak (Mp) in the range of from about 22,000 to about 30,000 daltons, such as from about 22,500 to about 29,000 daltons. The toner particles prepared from such binder also exhibit a high molecular peak, for example of about 23,000 to about 32,000, such as about 23,500 to about 31,500 daltons, indicating that the molecular peak is driven by the properties of the binder rather than another component such as the colorant.

The toner particles can be blended with external additives following formation. Any suitable surface additives may be used in embodiments. Most suitable are one or more of $SiO_2$, metal oxides such as, for example, $TiO_2$ and aluminum oxide, and a lubricating agent such as, for example, a metal salt of a fatty acid (such as zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is optionally also used as an external additive for the toners of the disclosure, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. In embodiments, a commercially available zinc stearate known as Zinc Stearate L, obtained from Ferro Corporation, can be used. The external surface additives can be used with or without a coating.

In embodiments, the toners contain from, for example, about 0.1 to about 5 weight percent titania, about 0.1 to about 8 weight percent silica and about 0.1 to about 4 weight percent zinc stearate.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2% to about 10% by weight of toner and about 90% to about 98% by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

It is envisioned that the toners of the present disclosure may be used in any suitable procedure for forming an image with a toner, including in applications other than xerographic applications.

An example is set forth herein below and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLE I

This method for obtaining the polyhydroxyalkanoates latex emulsion of the copolyester containing randomly arranged units of 3-hydroxybutyrate (HB) and 3-hydroxyvalerate (HV), hereafter referred to as P(HB-co-HV), involves the fermentation of bacteria, specifically *Alcaligenes eutrophus*, supplied with two carbon sources under nutrient limited conditions (Ramsay et al, 1990; Ryu et al, 1997; Shimizu et al, 1999). The seed culture is incubated and agitated within a nutrient-rich medium containing 10 g/L glucose, 1 g/L $(NH_4)2SO_4$, 0.2 g/L $MgSO4_4.7H_2O$, 1.5 g/L $KH_2PO_4$, 9 g/L $Na_2HPO_4.12H_2O$, and 1 mL/L trace element solution (10 g/L $FeSO_4.7H_2O$, 2.25 g/L $ZnSO_4.7H_2O$, 1 g/L $CuSO_4.5H_2O$, 0.5 g/L $MnSO_4.5H_2O$, 2 g/L $CaCl_2.2H_2O$, 0.23 g/L $Na_2B_4O_7.7H_2O$, 0.1 g/L $(NH_4)_6Mo_7O_{24}$, and 10 mL/L 35% HCl). Exponentially growing cells are harvested from this container to inoculate the bioreactor for the fed-batch culture. Initial agitation speed and air flow rate are 300 rpm and 2 L/min, respectively. During cultivation, agitation and aeration maintain the dissolved oxygen concentration above 40% air saturation. Similarly to the seed culture, temperature and pH are strictly controlled within the bacteria's preferred range, 34° C. and 6.8, respectively. pH is maintained with a 2N HCl solution and a 28% $NH_4OH$ solution The reactor medium is similar to that used for the seed culture (20 g/L glucose, 4 g/L $(NH_4)_2SO_4$, 1.2 g/L $MgSO_4.7H_2O$, 1.7 g/L citric acid, and 10 mL/L trace element solution), however, it is not nutrient-rich. Phosphate is limiting. It is initially added in an amount (5.5 g/L $KH_2PO_4$) calculated to give a particular dry weight of cells. At the point of nutrient limitation a feed solution of 132 g/L glucose and 18 g/L propionic acid is fed into the reactor at a rate of 35 mL/h. Cells respond by accumulating P(HB-co-HV). Note that one way to control the HB:HV composition within the resulting copolyester is to adjust the ratio of glucose to propionic acid in the feed. At the completion of the fermentation the copolyester is harvested.

The entire non-solvent based recovery procedure is performed within the fermentor, involving the solubilization of biomass and subsequent filtration to yield latex as the final product (de Koning & Witholt, 1997; de Koning et al, 1997). This is known as the enzymatic digestion method. The reactor ramps to sterilization temperature, 121° C., to kill cells. Following this it is cooled rapidly to 55° C. The pH is adjusted and maintained at 8.5 and an excess of protease (Alcalase), EDTA, and SDS is added. After half an hour the sterile recirculation loop containing a 0.1 μm filter is connected and diafiltration commences. To maintain constant volume water is added according to the filtrate output and pressurized air supplies regular back flushing on the filtrate outlet. The process of the diafiltration is monitored via spectrophotometry. The filtrate is initially yellow and shows an absorbance at 350 nm. The water supply is disconnected when the absorbance of the filtrate is negligible. Diafiltration becomes common filtration until the retentate is concentrated to 300 g/L. The latex is harvested from the recirculation loop with particles having an average size of 230 nm. The emulsion is adjusted to 20% solids. An emulsion aggregation toner using P(HB-co-HV) as the only resin is made utilizing the resulting latex. The desired overall solids content within the reaction vessel after homogenization and before toner growth is 11.50%. The semicrystalline core latex is weighed out such that the end dried toner is 77.5% P(HB-co-HV) by weight. Millipore water is added to the 3 L glass reaction vessel. While the contents stir, anionic surfactant (Dowfax), a water based dispersion of cyan pigment (solid content of 14.54%), and an emulsion of a crystalline polyester wax (solid wax particles of 200 nm and solid content of 30.80%) are added dropwise. The Dowfax, pigment, and wax are added such that the surfactant to core resin ratio is 2.22 pph and the end dried toner is 12.5% pigment by weight and 10.0% wax by weight. The pH is adjusted to 3.7 using 0.3M HNO3 and coagulant (28% $Al_2(SO_4)_3$ solution) is added during homogenization at 4000 rpm. The coagulant is added such that the Al to toner ratio is 0.44 pph. The mixture is heated at 40° C. to permit aggregation. At the point the toner particles reach a size of 7 μm and a number and volume GSD of both 1.20 the mixture is frozen to a pH of 7.0 using 1 M NaOH. Temperature is further increased to 100° C. to permit coalescence. The mixture is quenched at desired circularity and shape factor, 0.958 and 135, respectively. This is accomplished by pouring the mixture into a half filled bucket of ice. The emulsion aggregation toner particles are recovered by washing four times, each for 60 min, in deionized water and then freeze drying for two days. The dried toner has moisture content, Mw, Mn, and MWD of 0.50%, 30,000 Daltons, 11,000 Daltons, and 6.1, respectively.

What is claimed is:

1. A toner composition comprised of:

toner particles having a shape factor of about 105 to about 170 SF1*a, the toner particles comprising:

a semicrystalline biodegradable polyester resin having particles with a size of less than 250 nm in diameter;

a colorant;

a wax; and a coagulant, wherein said toner composition is formed by emulsion aggregation.

2. A toner composition of claim 1 wherein the semicrystalline biodegradable polyester resin is polyhydroxyalkanoate (PHA) represented by Formula (1):

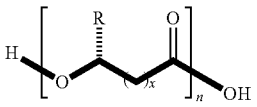

wherein R is H or a substituted or unsubstituted alkyl group having from 1 to about 13 carbon atoms, X is 1 to about 3, and n is from about 50 to about 10,000.

3. A toner composition of claim 2, wherein said polyhydroxyalkanoate is selected from the group consisting of polyhydroxybutyrate (PHB), polyhydroxyvalerate (PHV), copolyesters containing randomly arranged units of 3-hydroxybutyrate (HB) and 3-hydroxyvalerate (HV), and mixtures thereof.

4. The toner composition of claim 1, wherein said resin is made by a bacterium *Alcaligenes europhus.*

5. The toner composition of claim 1, wherein the resin has a particle size from about 50 to about 250 nm in diameter.

6. The toner composition of claim 1, wherein the resin is present in a shell of the toner particles.

7. The toner composition of claim 6, wherein the shell has a thickness from 0.1 to 5 microns.

8. The toner composition of claim 1, wherein the resin is present in the toner particles, exclusive of any optional external additives, and on a dry weight basis, in an amount of from about 70 to about 95% by weight of the toner particles.

9. The toner composition of claim 1, wherein the coagulant is selected from the group consisting of polyaluminum halides, polyaluminum silicates, polyaluminum hydroxides, and polyaluminum phosphate.

10. The toner composition of claim 1, wherein the wax is an alkylene wax present in an amount of about 5% to about 15% by weight based upon the total weight of the composition.

11. The toner composition of claim 1, wherein the wax is a polyethylene wax, a polypropylene wax, or mixtures thereof.

12. The toner composition of claim 1, wherein the colorant comprises a pigment, a dye, or mixtures thereof, in an amount of about 1% to about 25% by weight based upon the total weight of the composition.

* * * * *